US005182009A

United States Patent [19]

Matumoto

[11] Patent Number: 5,182,009

[45] Date of Patent: Jan. 26, 1993

[54] PLATING PROCESS

[75] Inventor: Sigeyuki Matumoto, Kanagawa, Japan

[73] Assignee: Mitsubishi Denki Kabushiki Kaisha, Japan

[21] Appl. No.: 644,824

[22] Filed: Jan. 23, 1991

[30] Foreign Application Priority Data

Jan. 23, 1990 [JP] Japan ..... 2-13080
Aug. 8, 1990 [JP] Japan ..... 2-211259

[51] Int. Cl.[5] ..... C25D 5/16; C25D 5/00
[52] U.S. Cl. ..... 205/238; 205/255
[58] Field of Search ..... 204/44.4, 43.1; 205/238, 255

[56] References Cited

U.S. PATENT DOCUMENTS 4,179,343 12/1979 Tremmel ..... 204/445
4,279,707 7/1981 Anderson et al. ..... 204/44.5
4,450,051 5/1984 Tremmel ..... 204/44.5

OTHER PUBLICATIONS

J. Horkans "Effect of Plating Parameters on Electrodeposited NiFe", J. Electro. vol. 128, No. 1, pp. 45–49, Jan. 1981.

Clauss et al "Decorative Coatings of Nickel-Iron Alloy", Plating, Aug. 1973 pp. 803–809.

*Primary Examiner*—John Niebling
*Assistant Examiner*—Brian M. Bolam
*Attorney, Agent, or Firm*—Wolf, Greenfield & Sacks

[57] ABSTRACT

Plating is achieved by selecting such a pH value that an increase of the weight composition of a metal to be plated and a decrease of the weight composition of said metal to be plated upon plating are compensated each other, and employing a plating solution of said selected pH value for plating.

6 Claims, 5 Drawing Sheets (UPPER CORE PLATING) PH AND Fe COMPOSITION DISTRIBUTION, DEPOSITION RATE (UPPER CORE PLATING) REPRODUCIBILITY EXPERIMENT (Fe COMPOSITION, Fe COMPOSITION DISTRIBUTION, DEPOSITION RATE, FILM THICKNESS DISTRIBUTION)

PLATING PROCESS

BACKGROUND OF THE INVENTION

1. Field of the Invention

The present invention relates generally to electroplating of single metals and alloys, and more particularly to electroplating of nickel-iron (Ni-Fe) alloy for example, and more specifically to a plating method of electroplating a uniform Ni-Fe composition alloy of film on a magnetic film such as an 80:20 Ni-Fe magnetic core thin film for use in a magnetic recording head for example.

2. Description of the Prior Art

A nickel-iron plated film used as a magnetic film has its magnetic properties severely varied depending on alloy compositions. Referring to FIG. 1, there is illustrated an interrelation between iron weight composition (wt %) and pH value of a plating solution, those pH values being a factor to influence the alloy composition. As the pH of the plating solution is raised, the iron weight composition (wt %) in the plating alloy is increased, the iron weight composition (wt %) has its maximum Fe when the pH is $i_2$, around which there is provided a smooth characteristic curve with reduced variations of the iron weight composition.

For bringing the alloy composition into its most stabilized state, selection may be made of the least variations of the iron weight composition with respect to the variations of the pH of the plating solution, say, a pH value $i_2$ of the plating solution. Accordingly, prior practice of the plating adopted such a pH of a plating solution that the iron weight composition is maximum.

With such prior practice where metal is plated under a pH of a plating solution selected conventionally, iron ion concentration in the plating solution is decreased following the deposition of a plated film and hence an iron weight composition in the plated film is also decreased, so that iron ion must be replenished into the plating solution during the plating to assure uniform components in the direction of film thickness. The prior practice therefore surffers from difficulties that there is required an additional dropping device using a high precision constant capacity pump as well as requiring much labor for its operation, followed by a difficulty in reliability and reproducibility on whether or not uniform components have been yielded in the direction of film thickness.

SUMMARY OF THE INVENTION

In view of the drawbacks with the prior art, it is an object of the present invention to provide a plating method wherein an alloy composition in the direction of the film thickness can be uniformalized even without any replenishment of metal ion (iron ion for example) in the course of plating.

In accordance with the present invention, a pH is selected such that an increase ($\Delta Fe$) of the weight composition ($Fe_1$) of a metal to be plated (iron for example) due to an increase ($\Delta I$) of a pH value in a plating solution occurring upon plating and a decrease ($\Delta Fe$) of the weight composition ($Fe_1$) of the metal to be plated occurring owing to a decrease of ion (iron ion) concentration of the metal to be plated upon the plating are compensated, and the metal is subjected to the plating with use of the plating solution of the selected pH.

For example, where plating is carried out with use of a plating solution of a pH $i_1$, an increase ($\Delta Fe$) of the weight composition ($Fe_1$) of a metal to be plated due to an increase ($\Delta I$) of the pH and a decrease ($\Delta Fe$) of the weight composition ($Fe_1$) of the metal to be plated due to a decrease of metal ion (iron ion) concentration of the metal to be plated in the plating solution are compensated each other, thereby providing uniform weight composition ($Fe_1$) of the metal to be plated in the course of the plating.

The above and other objects, features, and advantages of the invention will become more apparent from the following description when taken in conjunction with the accompanying drawings.

DESCRIPTION OF THE PREFERRED EMBODIMENT

Figure 1:
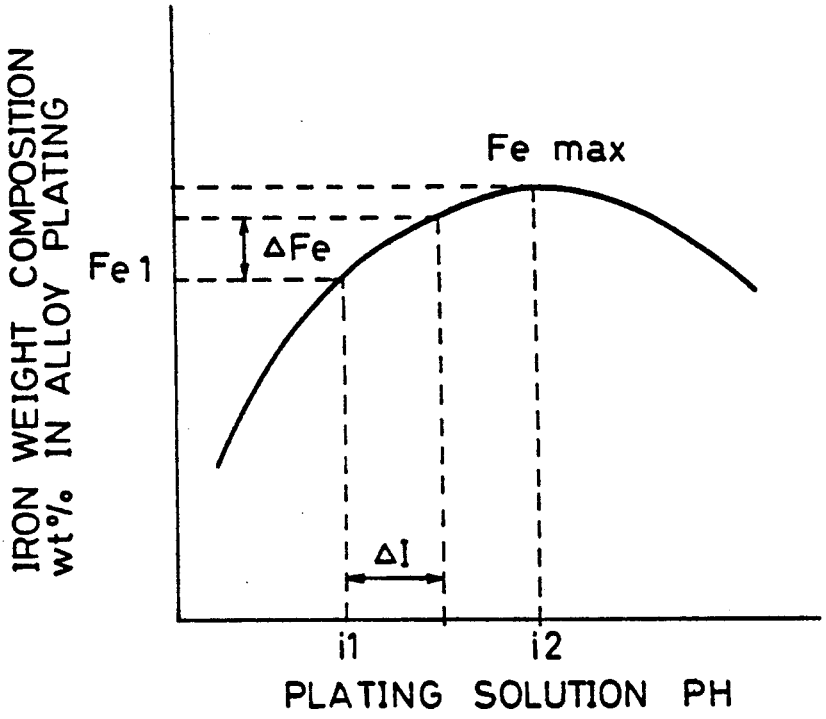
FIG. 1 is a view illustrating a change in iron weight composition with respect to pH values.
Figure 2:
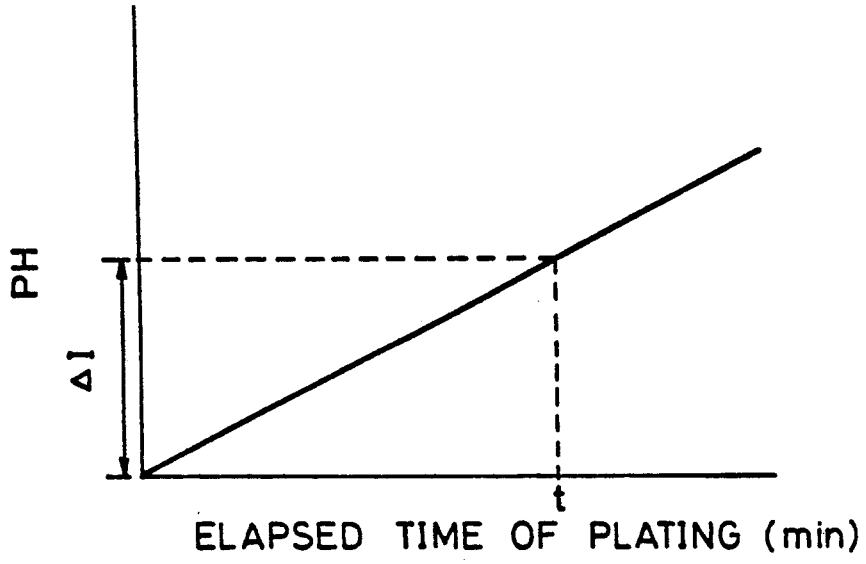
FIG. 2 is a view illustrating a change in pH values with respect to the elapsed time of plating.

As described previously, a nickel-iron plated film for example used for a magnetic film sharply relies in its magnetic properties upon distinct alloy compositions, for a factor to control the alloy composition, there is known the pH of a plating solution as illustrated in FIG. 1. The pH in a plating solution is increased in proportion to the elapsed time of plating as illustrated in FIG. 2. Additionally, Fe ion (ion of metal to be plated) concentration in the plating solution is decreased in proportion to the elaspsed time of the plating and hence an iron weight composition during alloy plating is also decreased, as illustrated in FIG. 4.

Figure 3:
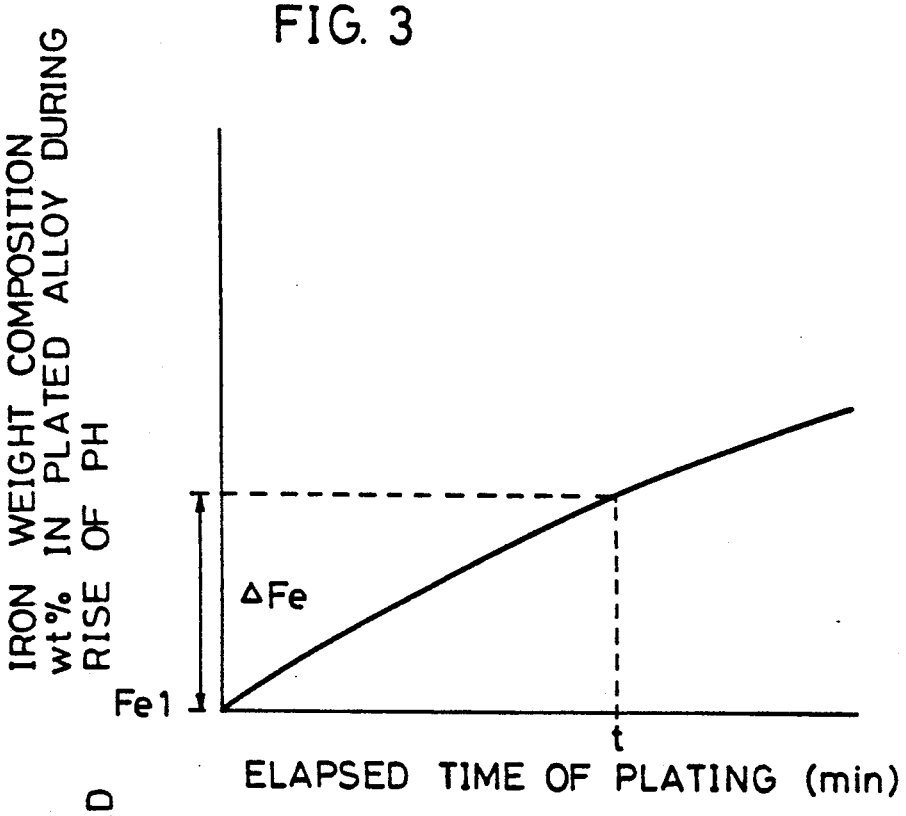
FIG. 3 is a view illustrating a change in iron weight composition in alloy plating upon the rise of pH with respect to the elapsed time of plating.
Figure 4:
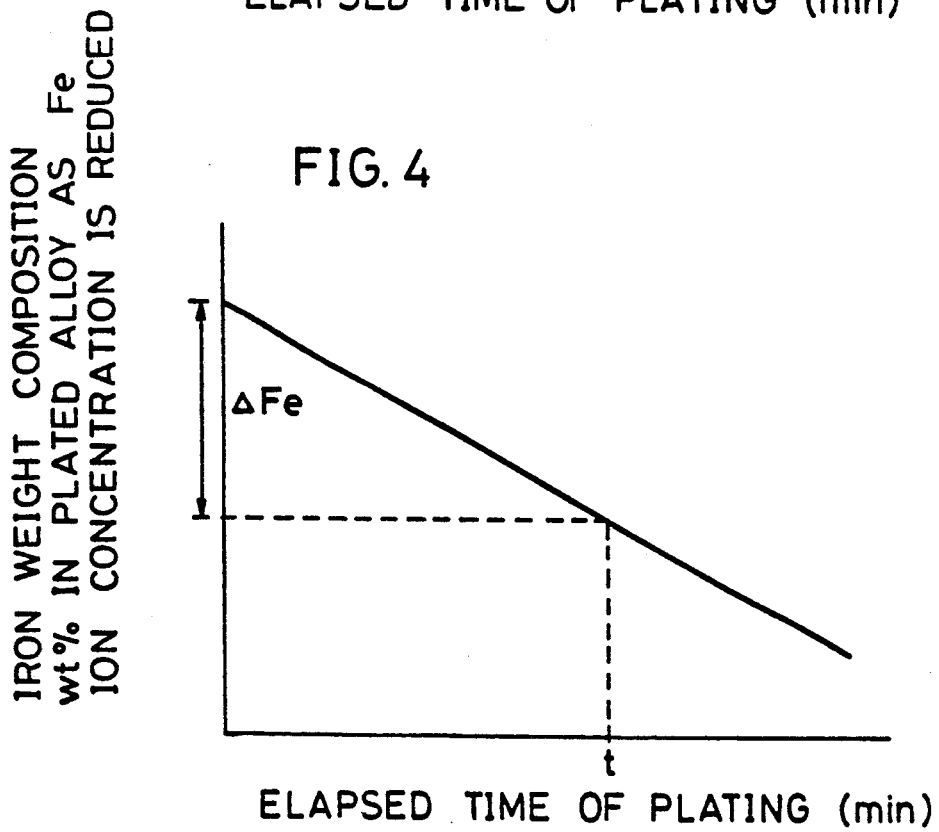
FIG. 4 is a view illustrating a change in the iron weight composition in the alloy plating as Fe ion concentration is reduced, with respect to the elapsed time of plating.

More specifically, for example, when there is denoted by $\Delta Fe$ the amount of a decrease of an iron weight composition during alloy plating as the Fe ion concentration in the plating solution is decreased with plating time assumed to be 7 minutes, in FIG. 4, and when there is denoted by $\Delta I$ the degree of the rise of the pH after the lapse of 7 minutes of the plating time in FIG. 2, there is selected an iron weight composition $Fe_1$ where the amount of the increase of the iron weight composition during the alloy plating upon the rise of the pH at the plating time of 7 minutes is the same as that $\Delta Fe$ of the decrease of the foregoing iron weight composition, as shown in FIG. 3, and a pH value $i_1$ at the iron weight composition $Fe_1$ is selected from FIG. 1.

When 7 minute plating is carried out at the pH $i_1$ selected in FIG. 1, the pH rises by ΔI. Thereupon, an alloy component ratio in the thickness direction of a resulting film is made uniform because the amount ΔFe of the increase of the iron weight composition ratio during the alloy plating is equal to the amount ΔFe of the decrease of the iron weight composition during the alloy plating in the decrease of the Fe ion concentration.

In the following, there will be described a rational base in the electroplating of a nickel-iron alloy on why the uniform plating is achieved by cancellation between the amount ΔFe of the increase of the iron weight composition in the alloy plating and the amount ΔFe of the decrease of the iron weight composition in the alloy plating as the Fe ion concentration is decreased. The pH of the plating solution during the plating is increased. Hereby, the deposition rate of highly pH-dependent Fe is increased. Herein, $Ni^{2+}$ is less pH-dependent than $Fe^{2+}$ is, so that the deposition rate of Ni remains substantially unchanged. Accordingly, provided $Fe^{2+}$ is replenished and $Fe^{2+}$ is kept constant, the Fe composition is increased (corresponding to the aforementioned ΔFe). However, where $Fe^{2+}$ need not be replenished as in the present invention, $Fe^{2+}$ concentration is reduced as the plating is advanced. With a plating bath volume of 17 l for example, the $Fe^{2+}$ concentration is decreased by the amount of Fe deposition (g)/17 (l). Although the Fe deposition rate is more reduced (by ΔFe in the case of the 17 l plating bath volume) than that of Ni is as the result of the justmentioned concentration decrease unless there is such $Fe^{2+}$ pH depending as described above, the pH dependency assures $+\Delta Fe-\Delta Fe=0$ and hence the Fe composition is kept unchanged.

In the following, the plating method will be described in terms of a concrete example. For the plating bath, there is employed an acidic bath which includes nickel sulfate, nickel chloride ($Ni^{2+}$ concentration, 10 g/l), iron sulfate ($Fe^{2+}$ concentration, 0.25 g/l or less), boric acid as a pH buffer, and other additives. The plating bath volume is set to 17 l for example, and plating temperature is set to predetermined temperature near room temperature. The degree of stirring of the plating solution sharply influences deposition conditions such as the deposition composition and thickness distribution, etc., of a plating solution, so that it is required for the degree of stirring to be strictly controlled. Herein, there is employed a stirring rod which reciprocates parallely to a wafer surface as an object to be plated in close vicinity of the same. Plating current density is lowered to the utmost, for example about 5 mA/cm$^2$.

Figure 5:
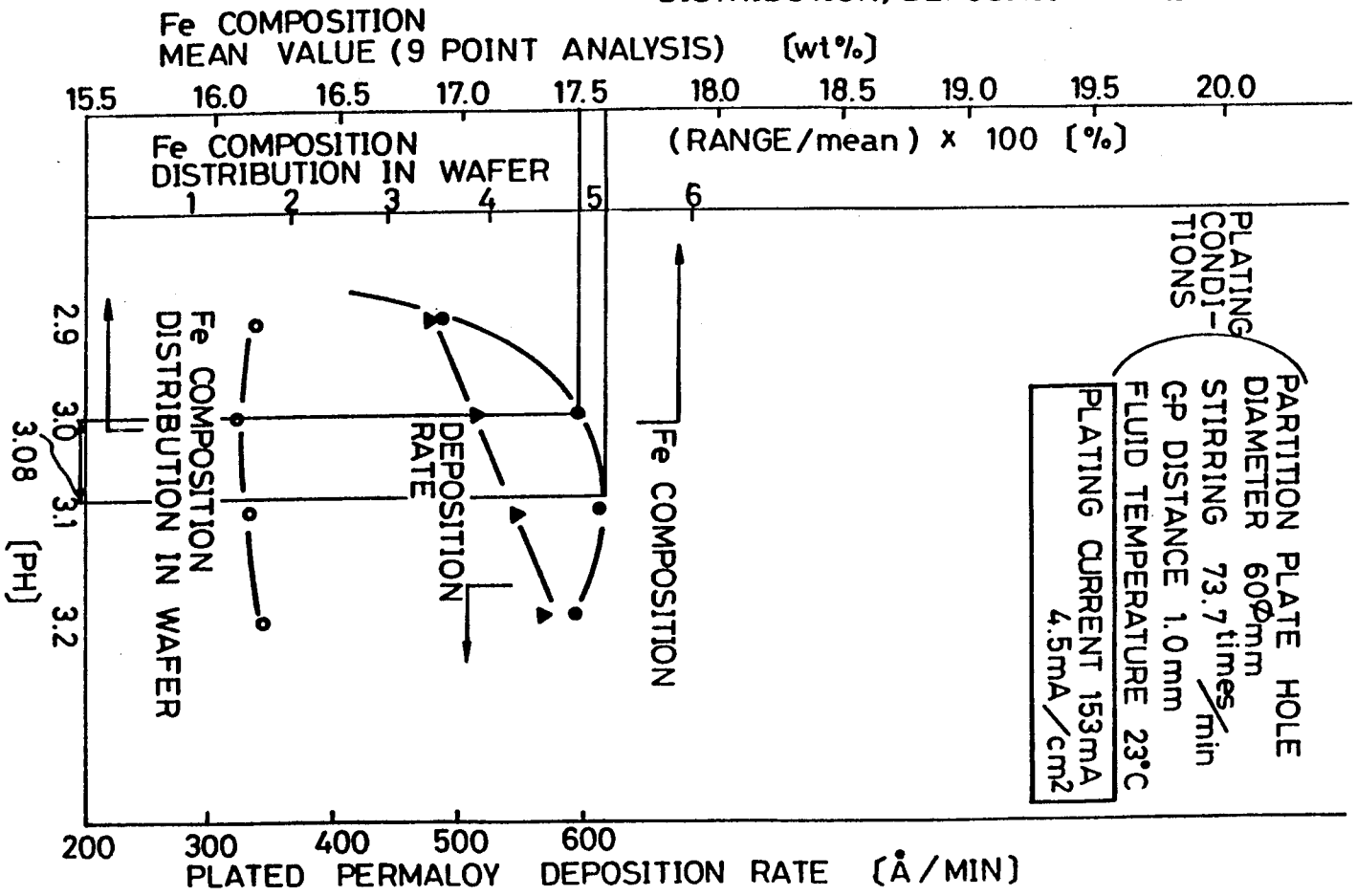
FIG. 5 is a graphical representation of an experimental result illustrating an interrelation among changes in Fe composition, distribution of the former, and deposition rates in the course of the plating of an upper core, with respect to pHs.

Referring now to FIG. 5, there is illustrated data as the plating is carried out under such conditions. As illustrated in FIG. 5, the weight composition $Fe_1$ of iron as a metal to be plated is 17.5 (wt %), the amount ΔFe of an increase or a decrease of the weight composition $Fe_1$ is 0.1 (wt %), and the amount ΔI of an increase of the pH in the plating solution occurring during the plating is 0.08 (pH).

Figure 6:
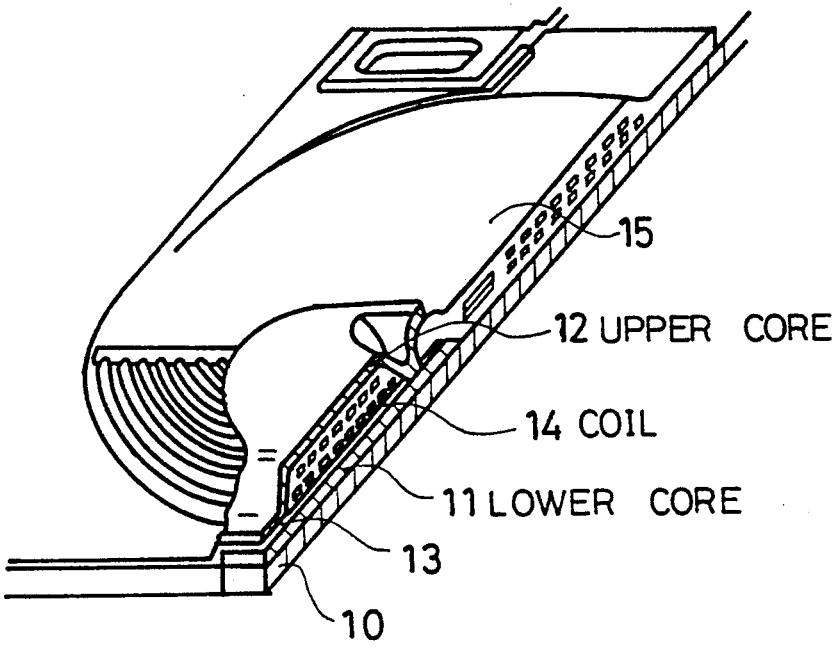
FIG. 6 is an enlarged view illustrating the structure of a thin film head element.

In the following, a case will be described in which the plating method of the present embodiment is applied to a computer 8 inch fixed disk device. Referring to FIG. 6, there is illustrated in an enlarged view the arrangement of a thin film head device in the 8 inch fixed disk device. The thin film head device is formed with laminating cores (upper core 12, lower core 11), a gap layer 13, a coil 14, and a protective film 15 on a three inch wafer 10 of 4 mm thick $Al_2O_3$/TiC (alumina/titanium carbide). The upper and lower cores 12 and 11 both located at the center of the film head device are coated with permalloy plating (alloy plating of Ni and Fe).

It has been commonly believed that the Fe composition ratios and film thicknesses of the upper and lower cores 12 and 11 sharply influence the electric characteristics of the head. Accordingly, for improving the yield of the electric characteristics of the head, there has been applied the plating method of the present invention in order to make uniform the Fe composition ratio and film thickness of the permalloy plating.

Figure 7:
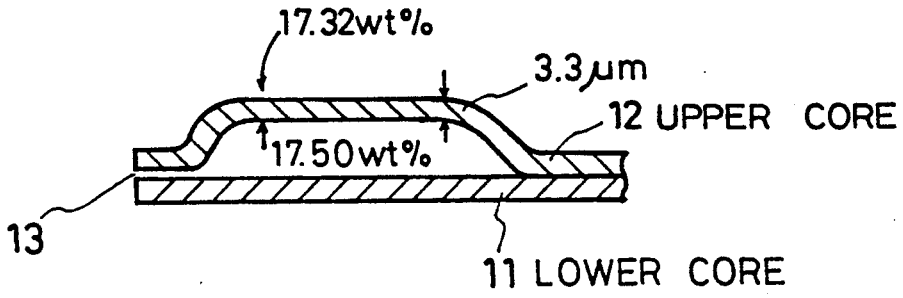
FIG. 7 PRIOR ART
FIG. 7 is a view illustrating the film thickness of the upper core.
Figure 8:
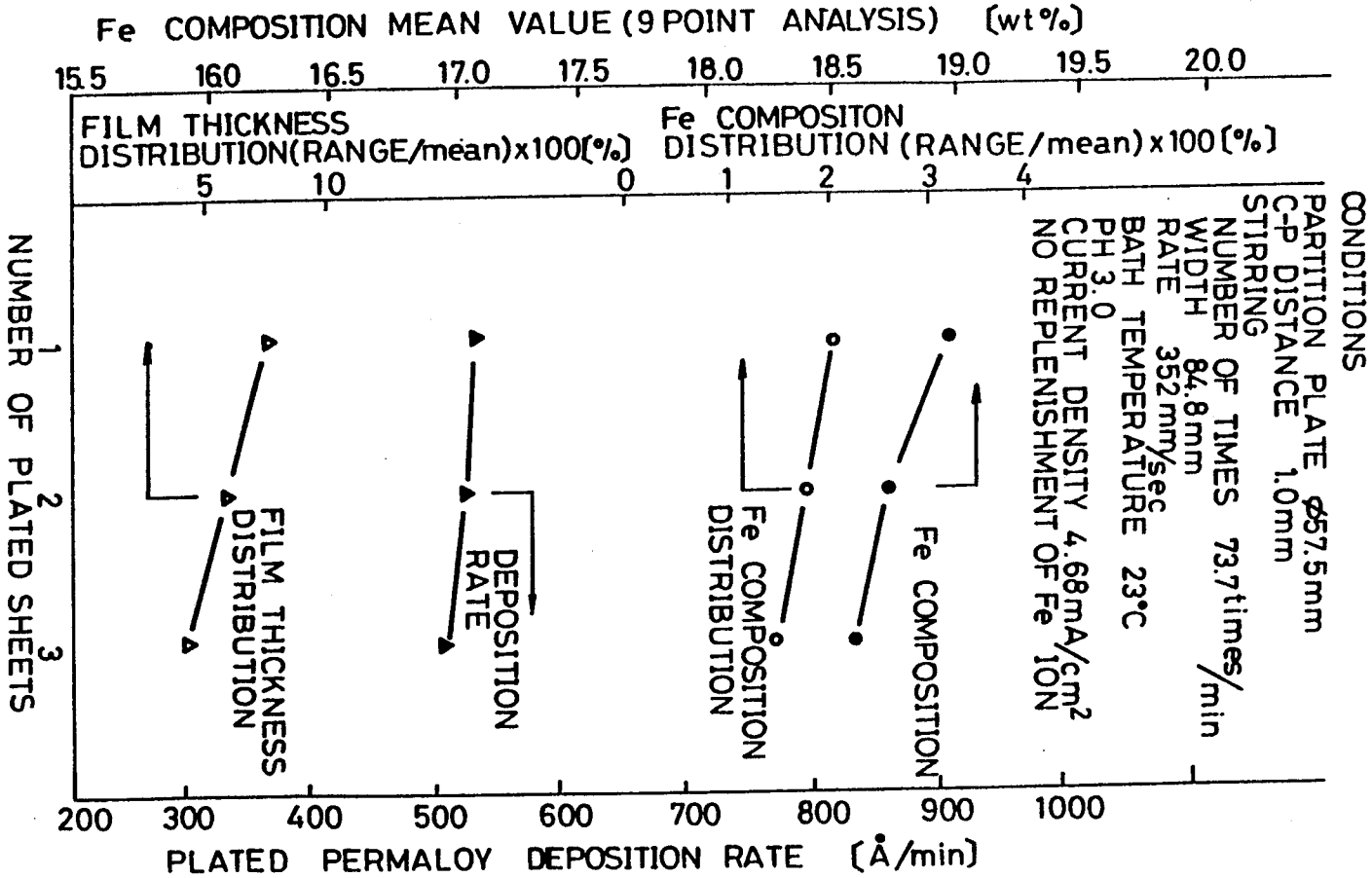
FIG. 8 is a graphical representation of an experimental result illustrating an interrelation among changes in Fe composition ratio, Fe composition ratio distribution, deposition rates, and film thickness distribution during the plating of the upper core, with respect to the number of plating sheets.

It should be noticed here that the alloy composition ratio of the upper core 12 in the thickness direction of the same shown in FIG. 6 is as illustrated in FIG. 8, but where plating is carried out at the conventional pH $i_2$ shown in FIG. 1, a difference between the lower and upper side Fe composition ratios of the upper coil is 17.5–17.32=0.18 (wt %) the film thickness of the upper core is 3.3 μm, as illustrated in FIG. 7. In this occasion, the use of the plating method of the above emobidment assures plating where the difference between the composition ratios is substantially 0.

According to the above embodiment, as described above, the iron weight composition ratio in the direction of the deposition of the plating deposition film is made uniform to yield a nickel-iron plated film with uniform magnetic properties.

Although in the above embodiment, the case of the electroplating of nickel-iron alloy was exemplified, any other similar plating may be used for formation of a magnetic film, which could achieve the same effect as in the above embodiment.

Now, another plating method other than the nickel-iron alloy plating will be described. The plating method of the present invention could satisfactorily be applied to other alloy platings having similar electrodeposition mechanisms. The deposition of Fe in the nickel-iron alloy plating in the above embodiment is considered to proceed in two steps as follows:

(1) $Fe^{2+}+2\ OH^- \rightarrow Fe(OH)_2$ (2) $Fe(OH)_2+2H^* \rightarrow Fe+2H_2O$ (H* is hydrogen from a hydrogen producer.)

The plating method in the above embodiment is carried out on the basis of the idea that hydroxide is once produced in the course of plating, as illustrated in the above two steps, which is different from other general plating methods. The Fe deposition rate according to the present plating method is therefore highly pH-dependent (pH is higher as $OH^-$ is higher.). For alloy plating under identical reaction, there are included Zn in Ni-Zn alloy plating, Co in Ni-Co alloy plating, and Zn in Fe-Zn alloy plating, etc. Also in these platings, alloy compositions can undergo precision control in a region of a rising slope in a relationship between pH and deposition rates.

In accordance with the present invention, as described above, a pH is selected where the increase of the weight composition of a metal to be plated due to the increase of a pH in a plating solution occurring in plating and the decrease of the same ratio due to the decrease of ion concentration of the metal in the plating are compensated each other, and the metal is plated using the plating solution of the selected pH. Accordingly, even though metal ion to be plated in not replenished, in the course of the plating, the weight composition of the metal in the direction of the deposition of a plated deposition film is made uniform, and hence an alloy film can be yielded which has been made uniform in the alloy composition in the direction of film thickness.

What is claimed is:

1. A method of plating a metal comprising the following steps: contacting said metal with a plating solution said plating solution having a pH and at least two metal ions, each metal ion having a concentration and said metal ions comprising at least one pH dependent metal ion, said pH dependent metal ion having a range of pH at which said pH dependent metal ion plates out of solution at a higher rate as the pH increases, and a range of concentration at which said pH dependent metal ion plates out of solution at a decreasing rate as the pH dependent metal ion concentration decreases; said pH and said pH dependent metal ion concentration selected such that during the period in which said metal is exposed to plating conditions, said plating solution has a range of pH, and a range of concentration of pH dependent metal ion at which such changes in pH and changes in pH dependent metal ion concentration cooperate to plate said pH dependent metal ion at a uniform rate; and imposing plating conditions for a period of time during which said pH and pH dependent metal ion concentration are within said range of pH and said range of concentration.

2. A plating method according to claim 1 characterized in that said metal ion comprises iron Fe.

3. A plating method according to claim 1 characterized in that said metal ion comprises cobalt Co.

4. A plating method according to claim 1 characterized in that said metal ion comprises zinc Zn.

5. A plating method according to claim 1 characterized in that said metal subjected to plating conditions is a component of a thin film head core.

6. A method of plating a metal comprising the following steps:

contacting said metal with a plating solution said plating solution having a pH and at least one metal ion, each metal ion having a concentration and said metal ions comprising at least one pH dependent metal ion, said pH dependent metal ion having a range of pH at which said pH dependent metal ion plates out of solution at a higher rate as the pH increases, and a range of concentration at which said pH dependent metal ion plates out of solution at a decreasing rate as the pH dependent metal ion concentration decreases; said pH and said pH dependent metal ion concentration selected such that during the period in which said metal is exposed to plating conditions, said plating solution has a range of pH, and a range of concentration of pH dependent metal ion at which such changes in pH and changes in pH dependent metal ion concentration cooperate to plate same pH dependent metal ion at a uniform rate; and imposing plating conditions for a period of time during which said pH and pH dependent metal ion concentration are within said range of pH and said range of concentration.

* * * * *